US009306345B2

(12) United States Patent
Hsu et al.

(10) Patent No.: US 9,306,345 B2
(45) Date of Patent: Apr. 5, 2016

(54) HIGH-DENSITY CABLE END CONNECTOR

(71) Applicant: SPEED TECH CORP., Taoyuan (TW)

(72) Inventors: Chien-Yu Hsu, Taoyuan (TW); Hua-Chun Chang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/602,215

(22) Filed: Jan. 21, 2015

(65) Prior Publication Data

US 2015/0236457 A1 Aug. 20, 2015

(30) Foreign Application Priority Data

Feb. 17, 2014 (TW) ..... 103202720 U

(51) Int. Cl.

| | |
|---|---|
| ***H01R 13/648*** | (2006.01) |
| ***H01R 24/30*** | (2011.01) |
| ***H01R 13/6594*** | (2011.01) |
| ***H01R 13/6582*** | (2011.01) |
| ***H01R 13/6586*** | (2011.01) |
| ***H01R 13/66*** | (2006.01) |
| *H01R 13/6461* | (2011.01) |

(52) U.S. Cl.

CPC ..... *H01R 24/30* (2013.01); *H01R 13/6582* (2013.01); *H01R 13/6586* (2013.01); *H01R 13/6594* (2013.01); *H01R 13/6658* (2013.01); *H01R 13/6461* (2013.01)

(58) Field of Classification Search

USPC ..... 439/607.31

See application file for complete search history.

(56) References Cited

U.S. PATENT DOCUMENTS

| | | | | |
|---|---|---|---|---|
| 7,524,193 | B2 | 4/2009 | Hashiguchi et al. | |
| 7,651,379 | B1 * | 1/2010 | Wu | H01R 12/62 439/108 |
| 8,152,568 | B2 * | 4/2012 | Wu | H01R 13/6658 439/353 |
| 8,167,631 | B2 | 5/2012 | Ito et al. | |
| 8,545,240 | B2 | 10/2013 | Casher et al. | |
| 8,968,031 | B2 * | 3/2015 | Simmel | H01R 13/659 439/108 |
| 2012/0315796 | A1 | 12/2012 | Pang et al. | |
| 2013/0005164 | A1 | 1/2013 | Smink et al. | |
| 2013/0034977 | A1 | 2/2013 | Cina et al. | |
| 2013/0309906 | A1 * | 11/2013 | De Geest | H01R 13/646 439/607.31 |

* cited by examiner

*Primary Examiner* — Tho D Ta

(74) *Attorney, Agent, or Firm* — CKC & Partners Co., Ltd.

(57) ABSTRACT

A high-density cable end connector for transmitting high-frequency signals includes a first sub-assembly, a second sub-assembly, a printed circuit board, a shielding plate, and a shielding shell. The first sub-assembly includes first contacts, a first insulator, and a first cover body. The second sub-assembly includes second contacts, a second insulator, and a second cover body. The printed circuit board includes pins connected to the first contacts and the second contacts. The shielding shell at least partially surrounds peripheries of the first sub-assembly and the second sub-assembly. The shielding plate is disposed between the first contacts and the second contacts and fixed to the first insulator or the second insulator for insulating the first contacts from the second contacts. Therefore, the high-density cable end connector is prevented from having crosstalk resulted by high frequency signals between the first contacts and the second contacts.

9 Claims, 6 Drawing Sheets

HIGH-DENSITY CABLE END CONNECTOR

RELATED APPLICATIONS

This application claims priority to Taiwanese Application Serial Number 103202720, filed Feb. 17, 2014, which is herein incorporated by reference.

BACKGROUND

1. Field of Invention

The present invention relates to a high-density cable end connector. More particularly, the invention relates to a connector for transmitting high frequency electronic signals with a frequency level up to more than Megahertz (MHz), and a cross-sectional unit area of the connector has plural contacts.

2. Description of Related Art

In recent years, the information technology has grown tremendously, and the amount of data transmitted between plural electronic devices is increased continuously. How to transmit a large amount of data in a shorter time is a main trend of development in the information technology. In addition to increasing the number of signal paths for transmitting electronic signals between the electronic devices, a general solution is to increase the frequency of the electronic signals transmitted between the electronic devices. A connector is a bridge for transmitting electronic signals between different electronic devices. As the requirement of the amount of transmitting data is increasing, the connector faces the challenge of the transmission of the high frequency electronic signals.

Due to the trend of miniaturization of electronic devices, the entire size of the connector has to be reduced continuously, and thus the distance between two conductive contacts arranged on the connector is also reduced continuously (i.e., the density of contacts per unit of cross-sectional area is increased). However, the continuously reduced distance between two conductive contacts is disadvantageous to the transmission of high frequency electronic signals, because the high frequency electronic signals transmitted by the respective conductive contacts easily cause crosstalk due to the small gaps of the conductive contacts, thus causing the original transmitted high frequency electronic signals to generate noise. Therefore, in the configuration of the connectors, the reasons disadvantageous to the transmission of high frequency electronic signals have to be taken into consideration, and should be controlled or resolved by appropriate measures so as to lower their substantial effects.

SUMMARY

Embodiments of the present invention provide a high-density cable end connector for transmitting high-frequency signals, and the connector is at least suitable for transmitting high frequency electronic signals with a frequency level up to more than Megahertz (MHz). The high-density connector refers to a connector having a greater amount of conductive contacts per unit of cross-sectional area, that is, the connector of which respective conductive contacts have smaller gaps.

According to one embodiment of the present invention, a high-density cable end connector includes a first sub-assembly, a second sub-assembly, a printed circuit board, a shielding plate, and a shielding shell. The first sub-assembly includes a first insulator, plural first contacts fixed in the first insulator, and a first cover body covering the first contacts and the first insulator. The second sub-assembly includes a second insulator, plural second contacts fixed in the second insulator, and a second cover body covering the second contacts and the second insulator. The shielding plate is disposed between the first contacts and the second contacts and fixed to the first insulator or the second insulator. The printed circuit board includes multiple pins, and the first contacts and the second contacts are connected to the pins on two opposite sides of the printed circuit board. The shielding shell at least partially surrounds peripheries of the first sub-assembly and the second sub-assembly.

In one or more embodiments, the shielding plate includes at least one extension portion extending outwards to be in contact with a ground end of the printed circuit board.

In one or more embodiments, the shielding plate includes a plate body and at least two fastening elements extending from the plate body, and the fastening elements are disposed at two opposite side edges of the plate body, and the first insulator includes two sub-fastening elements which are disposed at opposite edges of the first insulator and complementary in shape to the fastening elements, for fixing the shielding plate to the first insulator.

In one or more embodiments, the shielding plate includes a plate body and at least two fastening elements extending from the plate body, and the fastening elements are disposed at two opposite side edges of the plate body, and the second insulator includes two sub-fastening elements which are disposed at opposite edges of the second insulator and complementary in shape to the fastening elements, for fixing the shielding plate to the second insulator.

In one or more embodiments, the shielding plate includes at least one resilient arm connected to a shielding shell of an edge connector.

In one or more embodiments, the first cover body and the second cover body include two engaging elements respectively, and the engaging elements are proximate to the printed circuit board and complementary in shape to each other for fixing the first cover body to the second cover body.

In one or more embodiments, the first insulator and the second insulator include a positioning block respectively, the shielding shell has an opening corresponding to the positioning block, and the opening is engaged with the positioning block.

In one or more embodiments, the first contacts are embedded in the first insulator, and the second contacts are embedded in the second insulator.

In one or more embodiments, the shielding plate is embedded in the first insulator.

In one or more embodiments, the shielding plate is embedded in the second insulator.

In one or more embodiments, by disposing the shielding plate between the first contacts and the second contacts of the high-density cable end connector, and by grounding and removing the charges on the shielding plate through plural paths, the noise generated from the crosstalk caused by the high frequency electronic signals transmitted through the first contacts and the second contacts can be lowered, and therefore the high-density cable end connector is applicable to transmitting high frequency signals.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
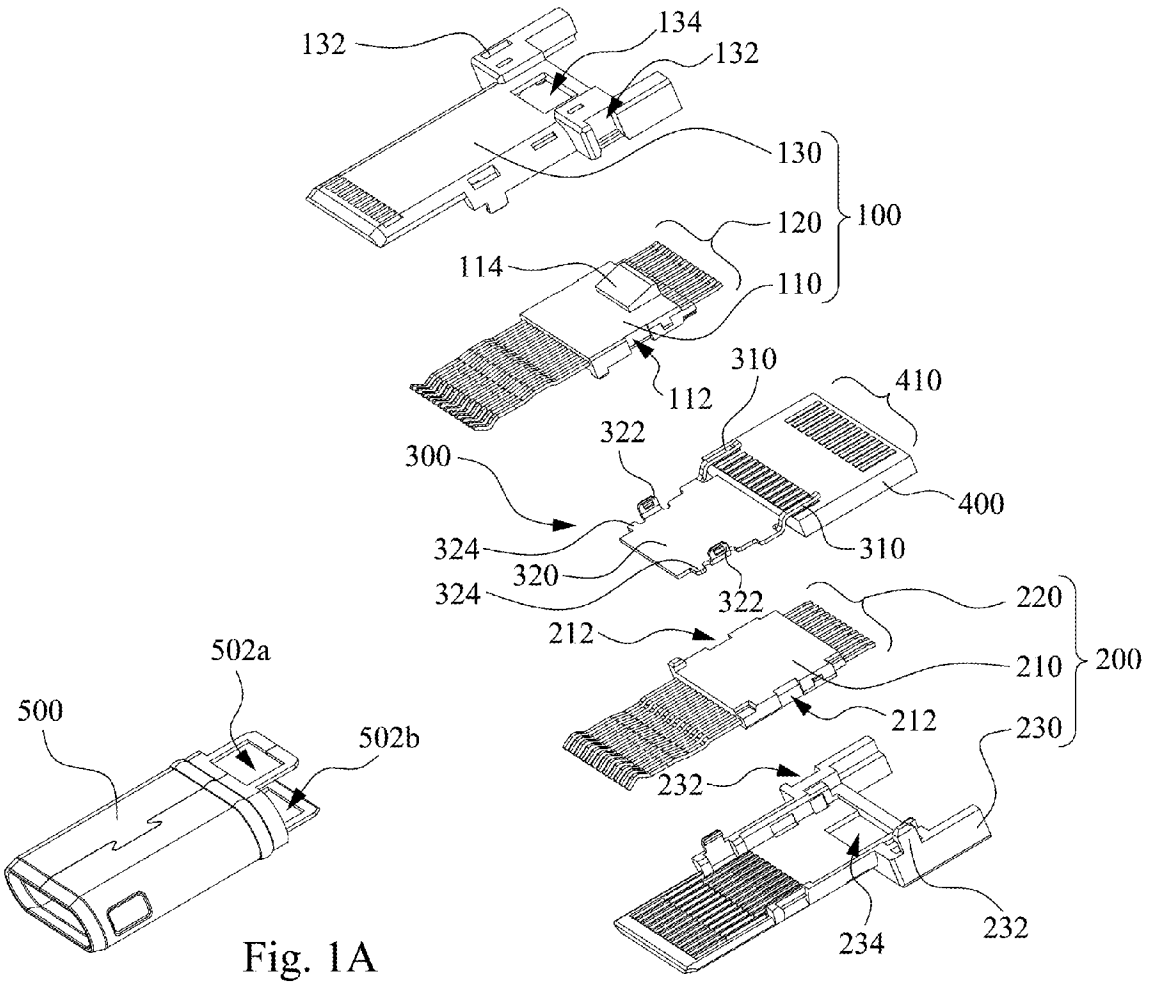
FIG. 1A is a schematic exploded view of a high-density cable end connector according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

According to one embodiment of the present invention, a high-density cable end connector for transmitting high-frequency signals is provided. FIG. 1A is a schematic exploded view of a high-density cable end connector according to an embodiment of the present invention. The high-density cable end connector includes a first sub-assembly 100, a second sub-assembly 200, a shielding plate 300, a printed circuit board 400, and a shielding shell 500. The first sub-assembly 100 includes a first insulator 110 and plural first contacts 120 fixed in the first insulator 110. The second sub-assembly 200 includes a second insulator 210 and plural second contacts 220 fixed in the second insulator 210. The shielding plate 300 is disposed between the first contacts 120 and the second contacts 220, and is fixed to the first insulator 110 or the second insulator 210. The printed circuit board 400 includes multiple pins 410, in which the first contacts 120 and the second contacts 220 are connected to the pins 410 on two opposite sides of the printed circuit board 400 respectively. In addition, the shielding shell 500 at least partially surrounds peripheries of the first sub-assembly 100 and the second sub-assembly 200.

The first sub-assembly 100 and the second sub-assembly 200 of the high-density cable end connector include a first cover body 130 and a second cover body 230 respectively. The first cover body 130 covers the first contacts 120 and the first insulator 110, and the second cover body 230 covers the second contacts 220 and the second insulator 210.

In one or more embodiments of the present invention, in the first sub-assembly 100, the first contacts 120 are embedded in the first insulator 110. In the second sub-assembly 200, the second contacts 220 are embedded in the second insulator 210. The first contacts 120 and the second contacts 220 can be integrally formed with the first insulator 110 and the second insulator 210 respectively through insert molding.

Regarding the assembly and the structure of the high-density cable end connector, the first cover body 130 and the second cover body 230 include an engaging element 132 and an engaging element 232 respectively, and the engaging elements 132 and 232 are proximate to the printed circuit board 400 and complementary in shape to each other. The engaging element 132 of the first cover body 130 can be engaged with the engaging element 232 of the second cover body 230. In this manner, the first cover body 130 and the second cover body 230 are fixed to each other. For example, one of the engaging elements 132 and 232 has a recess, and the other one of the engaging elements 132 and 232 has a protrusion. By coupling the recess with the protrusion, the engaging elements 132 and 232 can be engaged with each other, and thus the first cover body 130 and the second cover body 230 can be fixed to each other. In this embodiment, the two engaging elements 132 of the first cover body 130 are a recess and a protrusion respectively. The two engaging elements 232 of the second cover body 230 corresponding to the first cover body 130 are a protrusion and a recess respectively. Thus, the structural strength of the connection between the first cover body 130 and the second cover body 230 can be further enhanced.

Figure 1B:
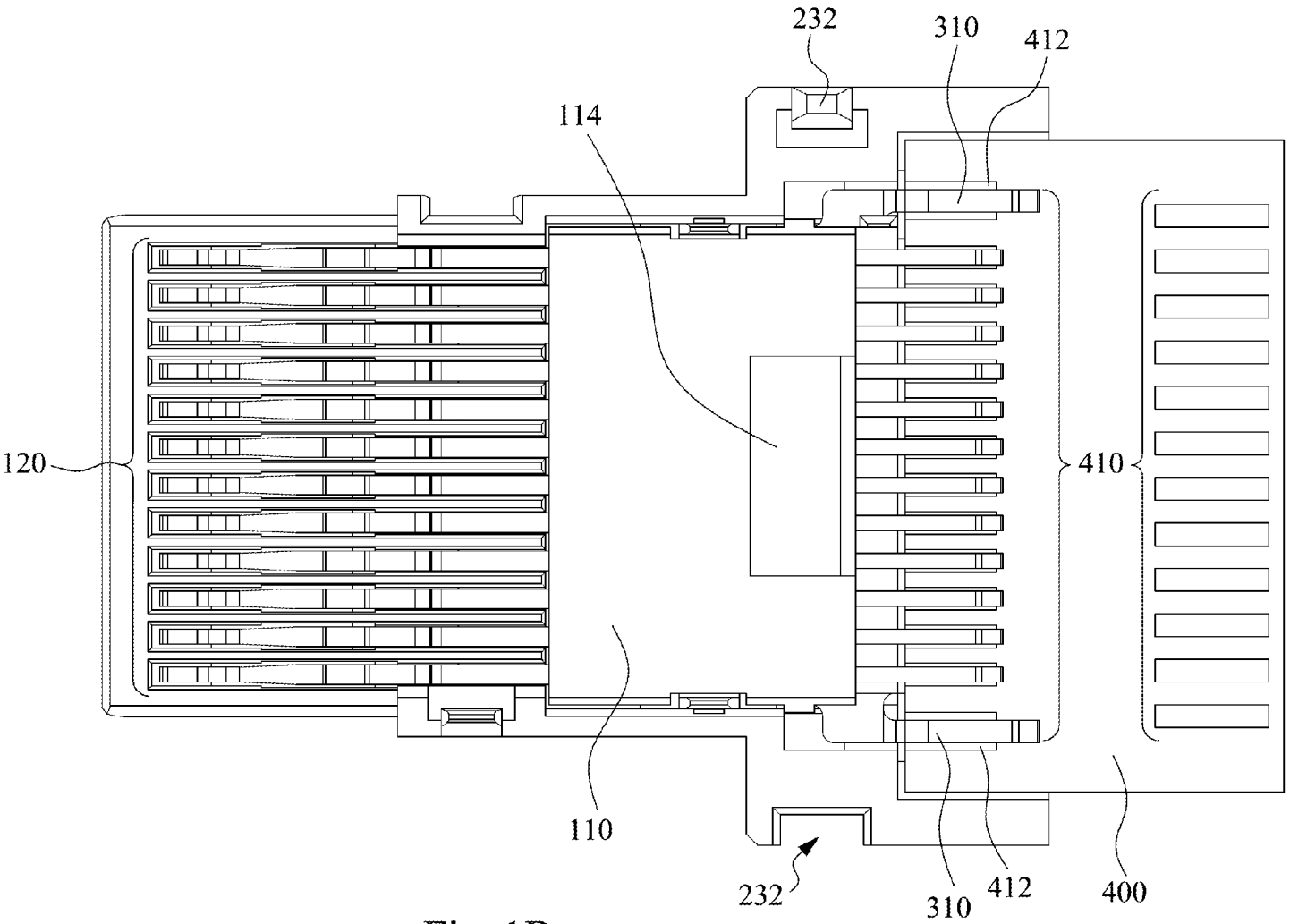
FIG. 1B is a schematic top view of the high-density cable end connector of FIG. 1A.

Reference is made to FIG. 1A and FIG. 1B. FIG. 1B is a schematic top view of the high-density cable end connector of FIG. 1A, in which the top view is viewed from the first sub-assembly 100 to the second sub-assembly 200. For clear illustration, the first cover body 130 and the shielding shell 500 are not depicted in FIG. 1B. Since the first insulator 110, the second insulator 210, and the shielding plate 300 are overlapped, the first insulator 110 can be observed in FIG. 1B, but the second insulator 210 and the shielding plate 300 are not shown. The shielding plate 300 includes at least one extension portion 310, and the extension portion 310 extends outwards from a plate body 320 of the shielding plate 300 and is in contact with a ground end 412 of the printed circuit board 400. As a result, the charges on the shielding plate 300 can be grounded through this path. The shielding plate 300 is formed by cutting a thin metal sheet, and thus shielding plate 300 can be used for shielding the electromagnetic waves to prevent the high frequency signals transmitted through the first contacts 120 and the second contacts 220 from being mutually interfered.

Figure 1C:
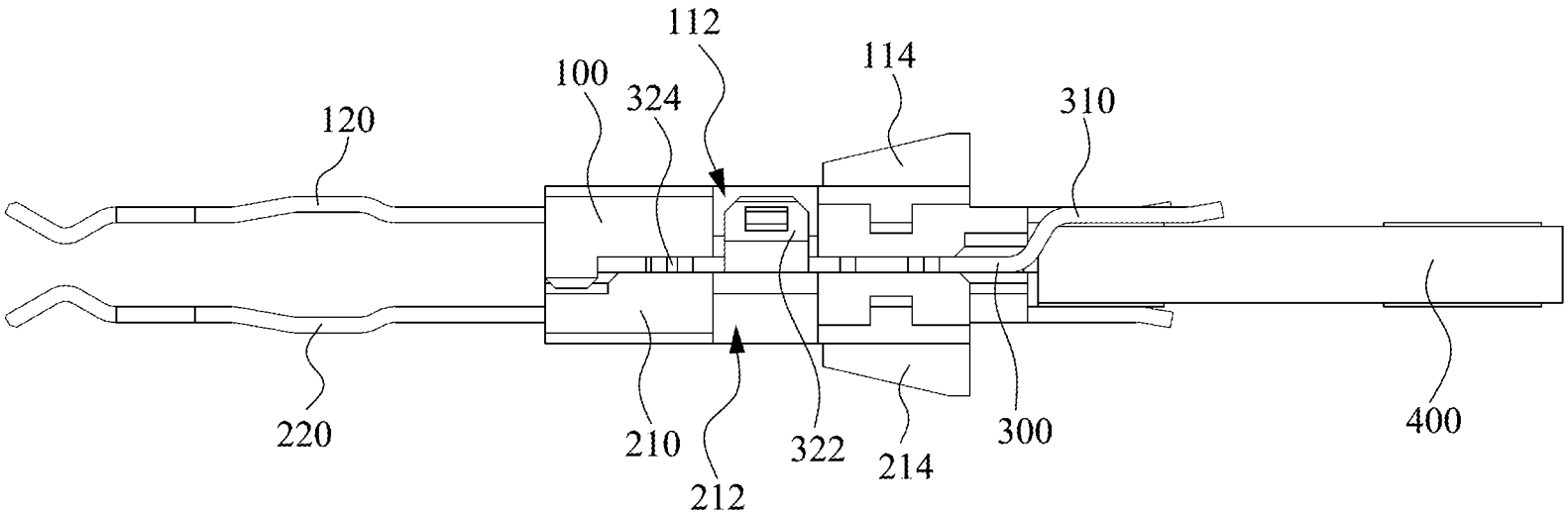
FIG. 1C is a schematic side view of the high-density cable end connector of FIG. 1A.

Reference is made to FIG. 1A and FIG. 10. FIG. 10 is a schematic side view of the high-density cable end connector of FIG. 1A. For clear illustration, the first cover body 130, the second cover body 230, and the shielding shell 500 are not depicted in FIG. 1C. In one or more embodiments of the present invention, the shielding plate 300 includes the plate body 320 and at least two fastening elements 322 extending from the plate body 320. The fastening elements 322 are used for fixing the shielding plate 300 between the first contacts 120 and the second contacts 220. The fastening elements 322 are disposed at two opposite side edges of the plate body 320. The first insulator 110 includes at least two sub-fastening elements 112 which are disposed at opposite edges of the first insulator 110 and complementary in shape to the fastening elements 322. The fastening elements 322 of the shielding plate 300 can be engaged with the sub-fastening elements 112 of the first insulator 110, and thereby the shielding plate 300 is fixed to the first insulator 110.

On the other hand, in one or more embodiments of the present invention, the shielding plate 300 includes the plate body 320 and at least two fastening elements 322 extending from the plate body 320. The fastening elements 322 are used for fixing the shielding plate 300 between the first contacts 120 and the second contacts 220. The fastening elements 322 are disposed at two opposite side edges of the plate body 320. The second insulator 210 includes at least two sub-fastening elements 212 which are disposed at opposite edges of the second insulator 210 and complementary in shape to the fastening elements 322. The fastening elements 322 of the shielding plate 300 can be engaged with the sub-fastening elements 212 of the second insulator 210, and thereby the shielding plate 300 is fixed to the second insulator 210.

Furthermore, the shielding plate 300 includes at least two lateral wings 324 extending from the plate body 320. The lateral wings 324 are disposed at two opposite side edges of the plate body 320. The lateral wings 324 are used to engage with the metal shell of the edge connector (not shown in the figure), and thus the charges on the shielding plate 300 can be grounded and removed through plural paths.

Regarding the assembly and the structure of the high-density cable end connector, the first insulator 110 may include a positioning block 114, and an opening 134 of the first cover body 130 and an opening 502*a* of the shielding shell 500 are disposed corresponding to the positioning block 114 in position. The positioning block 114 may pass through the opening 134 of the first cover body 130 and the opening 502*a* of the shielding shell 500, thereby fastening the first insulator 110, the first cover body 130, and the shielding shell 500 to each other. As a result, the first sub-assembly 110 can be fixed to the shielding shell 500. Similarly, the second insulator 210 may include a positioning block 214, and an opening 234 of the second cover body 230 and an opening 502*b* of the shielding shell 500 are disposed corresponding to the positioning block 214 in position. The positioning block 214 may pass through the opening 234 of the second cover body 230 and the opening 502*b* of the shielding shell 500, thereby fastening the second insulator 210, the second cover body 230, and the shielding shell 500 to each other. As a result, the second sub-assembly 210 can be fixed to the shielding shell 500. By using the aforementioned structural configuration constructed by the positioning block 114 of the first insulator 110, the positioning block 214 of the second insulator 210, the opening 134 of the first cover body 130, the opening 234 of the second cover body 230, the openings 502*a* and 502*b* of the shielding shell 500, and the engaging elements 132 and 232 between the first cover body 130 and the second cover body 230, the first sub-assembly 100, the second sub-assembly 200, and the shielding shell 500 can be fastened together.

In one or more embodiments of the present invention, in addition to assembling the aforementioned structural elements for fastening the shielding plate 300 to the first insulator 110 or the second insulator 210, the shielding plate 300 can be directly embedded in the first insulator 110 by insert molding. In another embodiment of the present invention, the shielding plate 300 can be directly embedded in the second insulator 210 by insert molding. As a result, the size of the integrated connector can be reduced, and the shielding plate 300 can be used to enhance the strength of the integrated connector. Furthermore, the first contacts 120, the second contacts 220, the first insulator 110, the second insulator 210, and the shielding plate 300 can be integrally formed by insert molding.

Figure 2A:
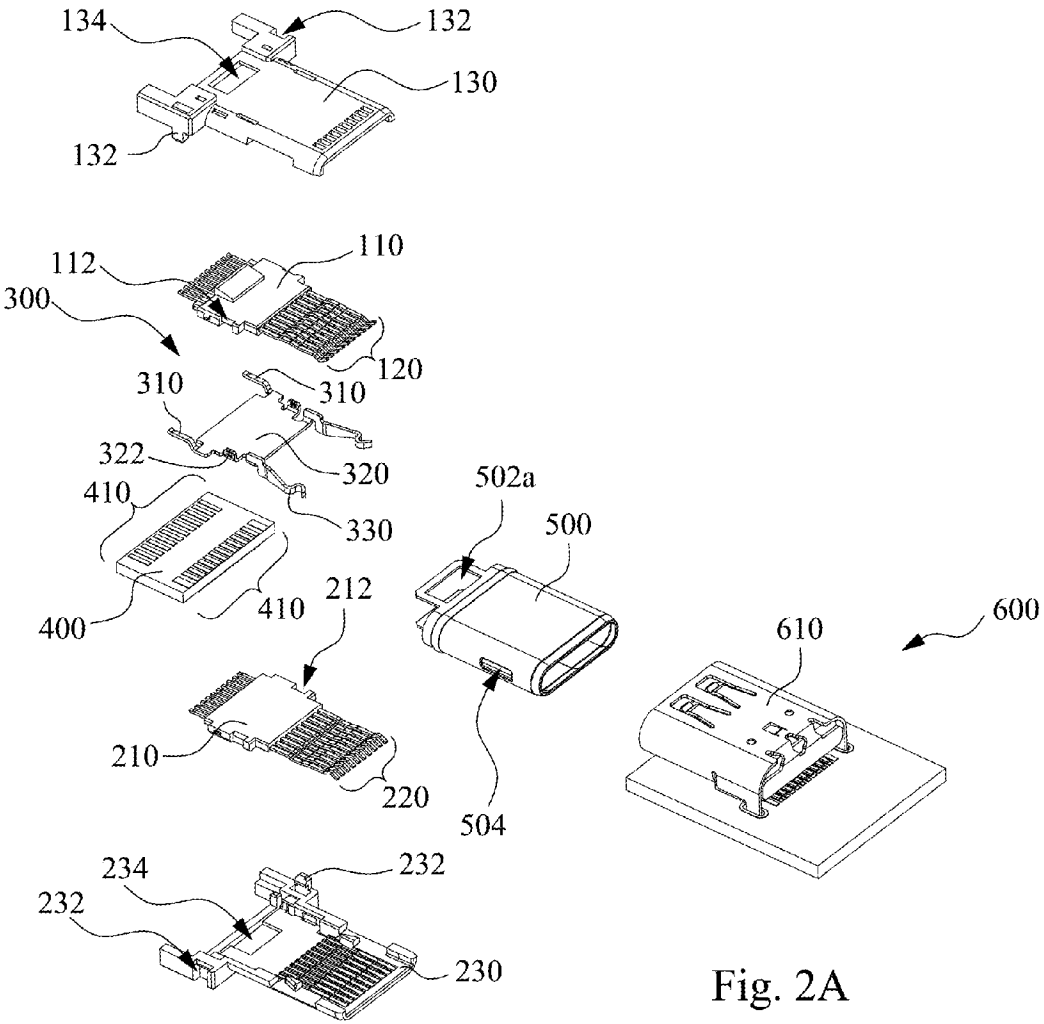
FIG. 2A is a schematic exploded view of a high-density cable end connector according to another embodiment of the present invention.

FIG. 2A is a schematic exploded view of a high-density cable end connector according to another embodiment of the present invention. The high-density cable end connector of FIG. 2A is derived from the high-density cable end connector of FIG. 1A, and thus has a similar basic structural configuration with the high-density cable end connector of FIG. 1A. In addition to the structural configuration described above, the difference between this embodiment and the embodiment of FIG. 1 resides in the configuration of the lateral wings 324 of the shielding plate 300. In this embodiment, the lateral wings 324 in the embodiment of FIG. 1 are changed to be at least one resilient arm 330 extending outwards from the shielding body 320 to enter the edge connector 600. In this embodiment, the resilient arm 330 has a bended shape, but the present invention is not limited thereto.

Figure 2B:
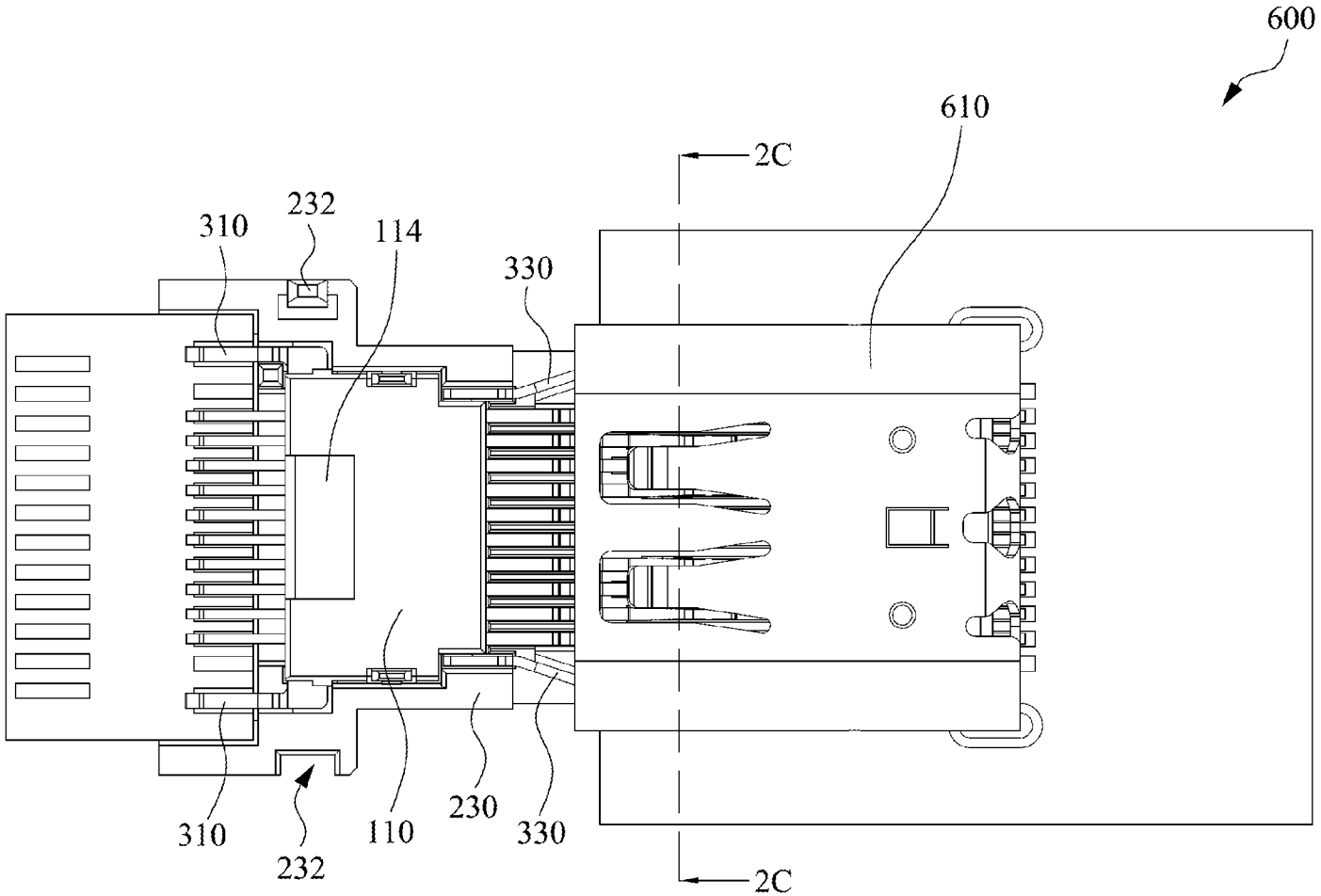
FIG. 2B is a schematic top view of the high-density cable end connector of FIG. 2A.
Figure 2C:
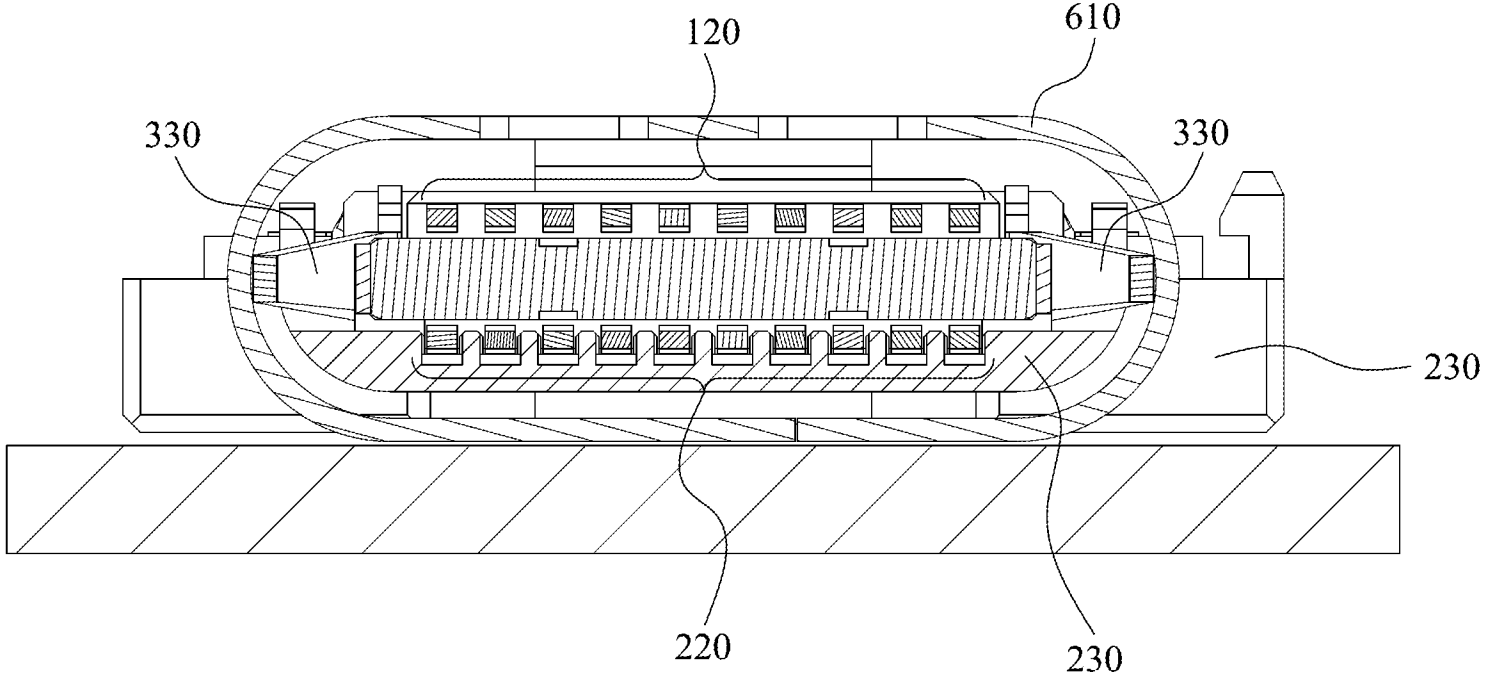
FIG. 2C is a schematic cross-sectional view of the high-density cable end connector viewed along a line 2C-2C of FIG. 2B.

FIG. 2B is a schematic top view of the high-density cable end connector of FIG. 2A. For clear illustration, the first cover body 130 and the shielding shell 500 are not depicted in FIG. 2B. When the high-density cable end connector is connected to the edge connector 600, the resilient arm 330 can be extended to enter the edge connector 600 to remove and ground the charges on the shielding plate 300 through plural paths. FIG. 2C is a schematic cross-sectional view of the high-density cable end connector viewed along a line 2C-2C of FIG. 2B. The resilient arms 330 are disposed at two sides of the first contacts 120 and the second contacts 220, and are in contact with the shielding shell 610 of the edge connector 600. Since the shielding shell 610 is made of metal material, the resilient arms 330 can be electrically connected to the shielding shell 610. As a result, the charges on the shielding plate 300 can be removed through the shielding shell 610 of the edge connector 600.

Referring to FIG. 2A, in one or more embodiments of the present invention, the shielding shell 500 of the high-density cable end connector may have a mating opening 504, in which the opening 504 is disposed at the two sides of the shielding shell 500 for exposing the resilient arm 330 of the shielding plate 300.

The shielding plate 300 is positioned between the first contact 120 and the second contacts 220 in the connector, and thus the disposition of the shielding plate 300 has a great influence on the entire transmission of high frequency electronic signals performed by the high-density cable end connector. For example, factors such as the distance between the shielding plate 300 and the first contact 120, the distance between the shielding plate 300 and the second contacts 220, and the shape of the shielding plate 300 have serious impacts on the impedances of the first contacts 120 and the second contacts 220 during the transmission of high frequency electronic signals. It is known that the variation of the impedance of the first contacts 120 and the second contacts 220 may result in energy consumption or return loss during the transmission of high frequency electronic signals. Therefore, one skilled in the art can obtain an appropriate impedance compensation through fine tuning the sizes of different parts of the shielding plate 300, the distance between the shielding plate 300 and the first contact 120, or the distance between the shielding plate 300 and the second contacts 220.

In the embodiments of the present invention, by disposing the shielding plate between the first contacts and the second contacts of the high-density cable end connector, and by grounding and removing the charges on the shielding plate through plural paths, the noise generated from the crosstalk caused by the high frequency electronic signals transmitted through the first contacts and the second contacts can be lowered, and thus the high-density cable end connector is applicable to transmitting high frequency signals.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A high-density cable end connector for transmitting high-frequency signals, the high-density cable end connector comprising:

a first sub-assembly comprising a plurality of first contacts, a first insulator, and a first cover body, wherein the first contacts are fixed in the first insulator, and the first cover body covers the first contacts and the first insulator;

a second sub-assembly comprising a plurality of second contacts, a second insulator, and a second cover body, wherein the second contacts are fixed in the second insulator, the second cover body covers the second contacts and the second insulator, and the first cover body is engaged with the second cover body;

a shielding plate disposed between the first contacts and the second contacts, wherein the shielding plate is fixed to the first insulator or the second insulator;

a printed circuit board comprising a plurality of pins, wherein the first contacts and the second contacts are connected to the pins on two opposite sides of the printed circuit board respectively; and a shielding shell at least partially surrounding peripheries of the first sub-assembly and the second sub-assembly.

2. The high-density cable end connector of claim 1, wherein the shielding plate comprises a plate body and at least one extension portion extending from the plate body, and the extension portion is in contact with a ground end of the printed circuit board.

3. The high-density cable end connector of claim 1, wherein the shielding plate comprises a plate body and at least two fastening elements extending from the plate body, and the fastening elements are disposed at two opposite side edges of the plate body, and the first insulator comprises at least two sub-fastening elements which are disposed at opposite edges of the first insulator and complementary in shape to the fastening elements, for fixing the shielding plate to the first insulator.

4. The high-density cable end connector of claim 1, wherein the shielding plate comprises a plate body and at least two fastening elements extending from the plate body, and the fastening elements are disposed at two opposite side edges of the plate body, and the second insulator comprises at least two sub-fastening elements which are disposed at opposite edges of the second insulator and complementary in shape to the fastening elements, for fixing the shielding plate to the second insulator.

5. The high-density cable end connector of claim 1, wherein the shielding plate comprises at least one resilient arm electrically connected to a shielding shell of an edge connector.

6. The high-density cable end connector of claim 1, wherein each of the first insulator and the second insulator comprise a positioning block, and the shielding shell has an opening corresponding to the positioning block, and the opening is engaged with the positioning block.

7. The high-density cable end connector of claim 1, wherein the first contacts are embedded in the first insulator, and the second contacts are embedded in the second insulator.

8. The high-density cable end connector of claim 7, wherein the shielding plate is embedded in the first insulator.

9. The high-density cable end connector of claim 7, wherein the shielding plate is embedded in the second insulator.

* * * * *